United States Patent [19]

Garr

[11] Patent Number: 4,607,774

[45] Date of Patent: Aug. 26, 1986

[54] WRAPPING TABLE ASSEMBLY

[76] Inventor: Ernest J. Garr, 3587 Powell Dr., Lafayette, Calif. 94549

[21] Appl. No.: 705,232

[22] Filed: Feb. 25, 1985

Related U.S. Application Data

[63] Continuation-in-part of Ser. No. 597,520, Apr. 6, 1984, abandoned, which is a continuation-in-part of Ser. No. 466,873, Feb. 16, 1983, abandoned, which is a continuation-in-part of Ser. No. 416,669, Sep. 10, 1982, abandoned.

[51] Int. Cl.[4] ..... B26F 3/02

[52] U.S. Cl. ..... 225/47; 225/53; 225/77; 242/55.53

[58] Field of Search ..... 225/77, 47, 53, 90, 225/46; 242/55.2, 55.3, 129.6, 129.62, 55.53, 58.6; 53/168, 390; 493/86; 83/649, 650

[56] References Cited

U.S. PATENT DOCUMENTS

| | | | |
|---|---|---|---|
| 1,593,529 | 5/1926 | Gibson et al. | 225/47 |
| 3,739,964 | 6/1973 | Stine | 225/47 |
| 3,800,499 | 4/1974 | Feldman | 53/168 |
| 4,097,002 | 6/1978 | Krueger | 242/55.2 |

*Primary Examiner*—James M. Meister
*Assistant Examiner*—John L. Knoble
*Attorney, Agent, or Firm*—Flehr, Hohbach, Test, Albritton & Herbert

[57] ABSTRACT

Wrapping table assembly for use with a roll of wrapping material such as plastic film. The assembly includes a table top supported by a base on which the roll of material is rotatively mounted. The assembly can be used with rolls of different widths.

21 Claims, 13 Drawing Figures

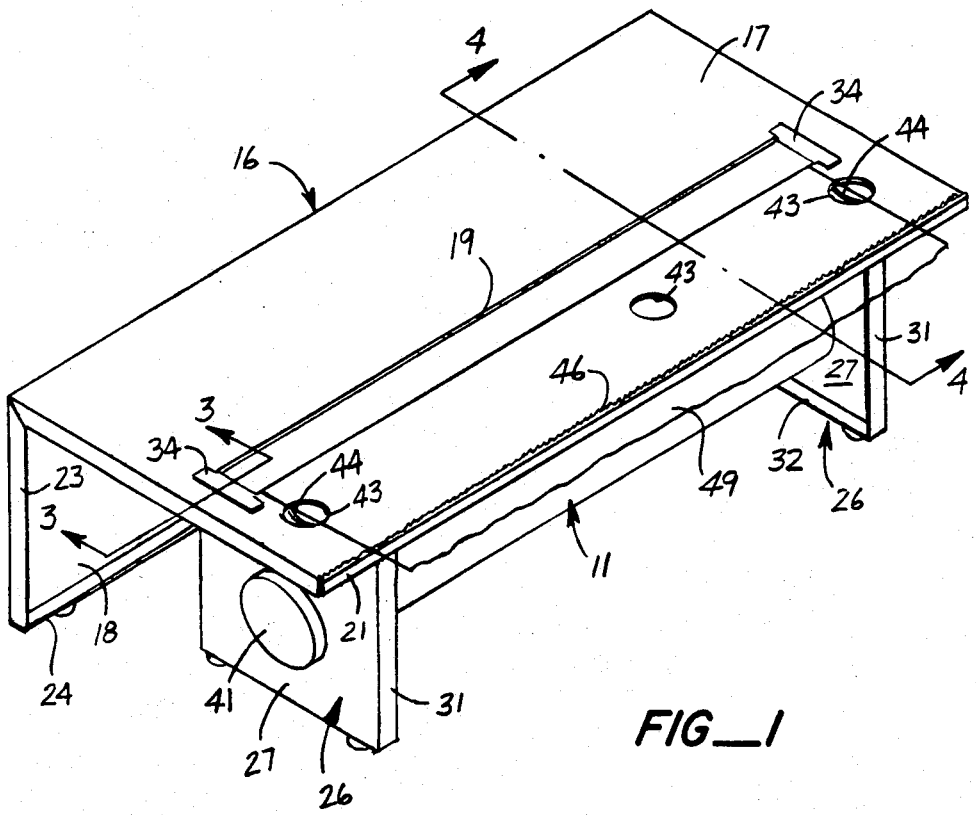
FIG_1
FIG_2
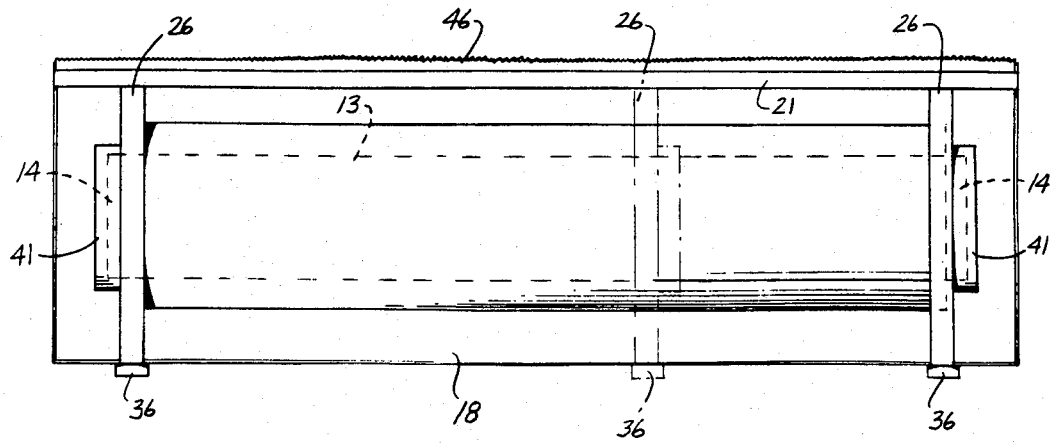

FIG_3
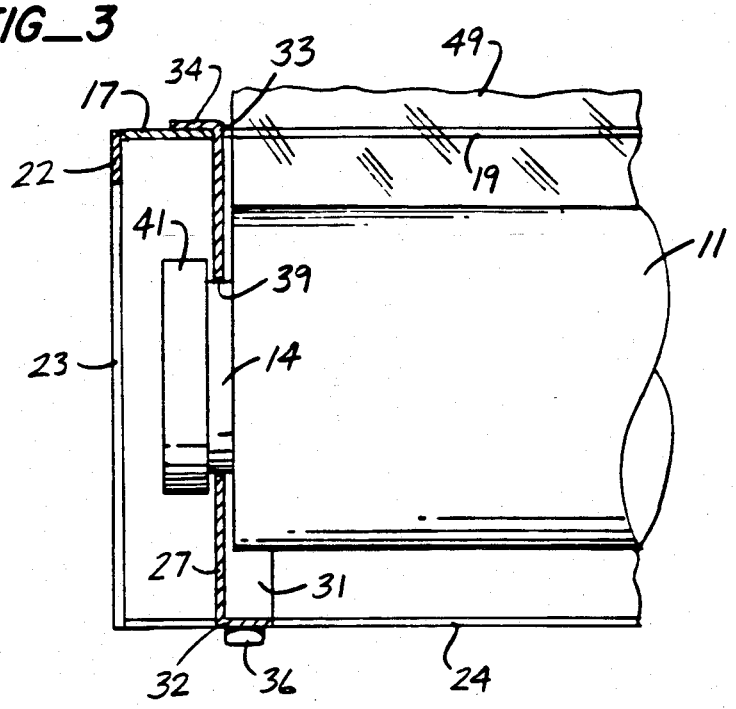
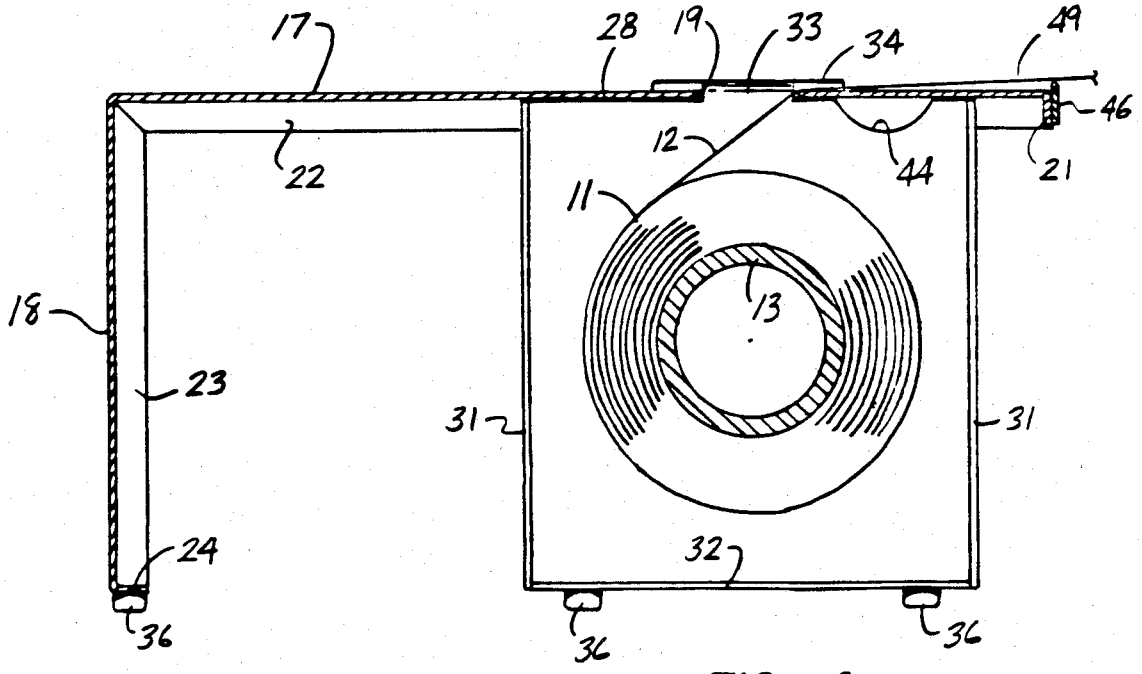
FIG_4

FIG_5
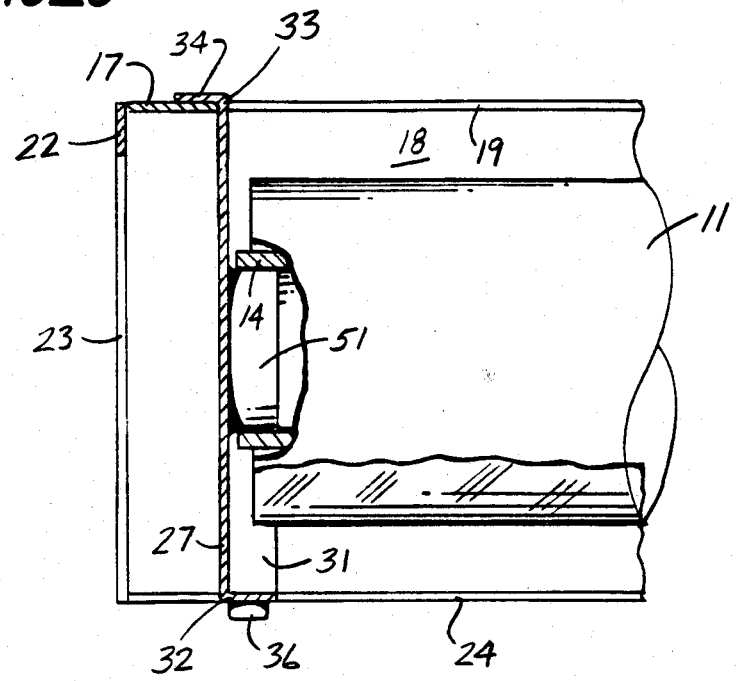
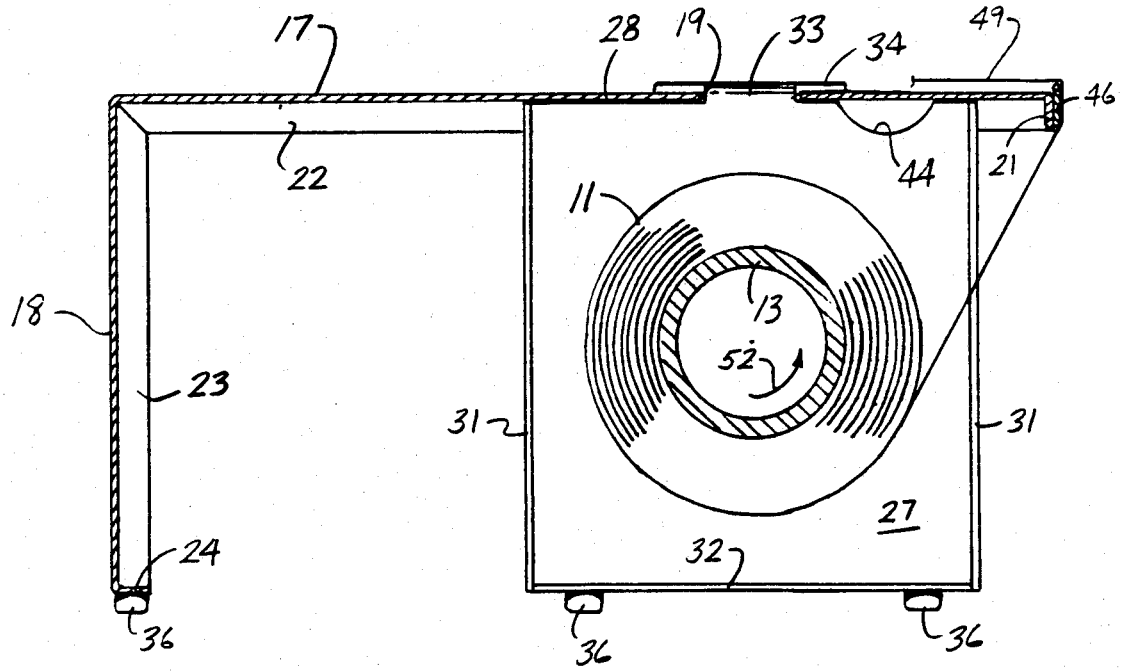
FIG_6

FIG_7
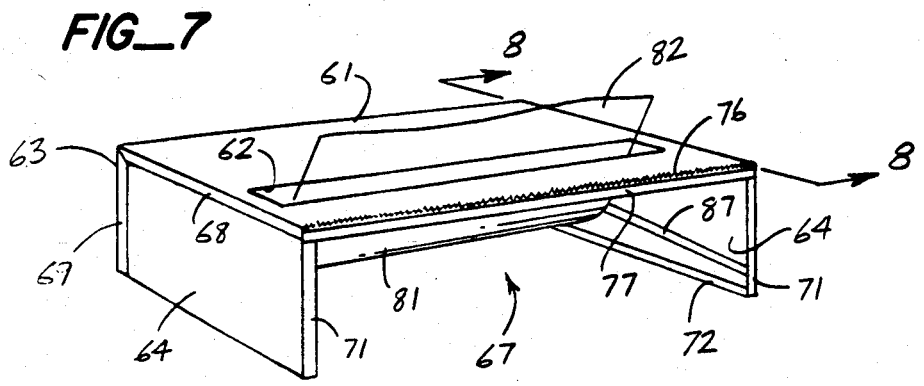
FIG_8
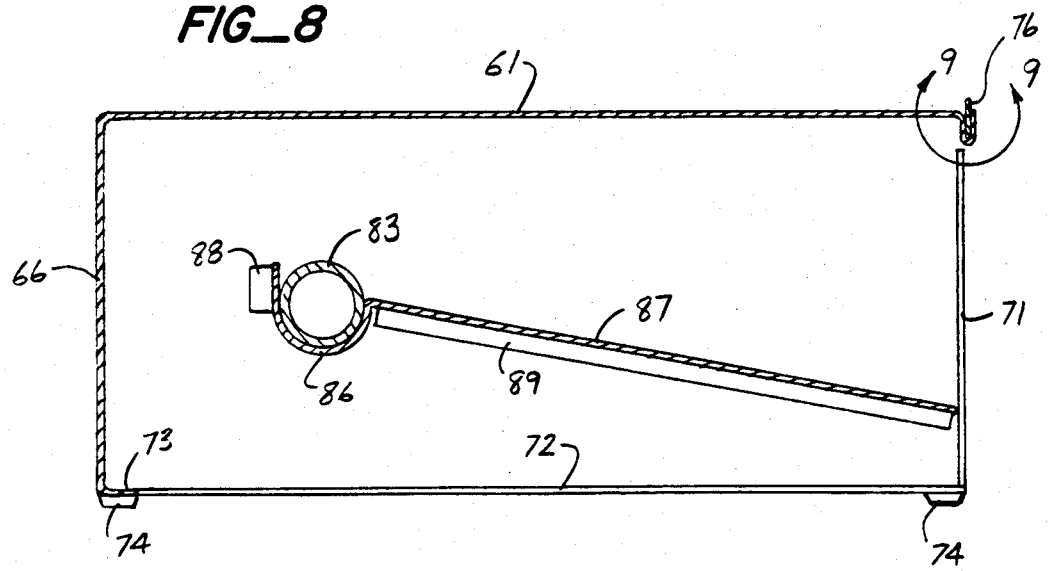
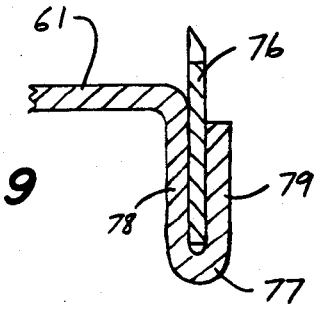
FIG_9

FIG_10
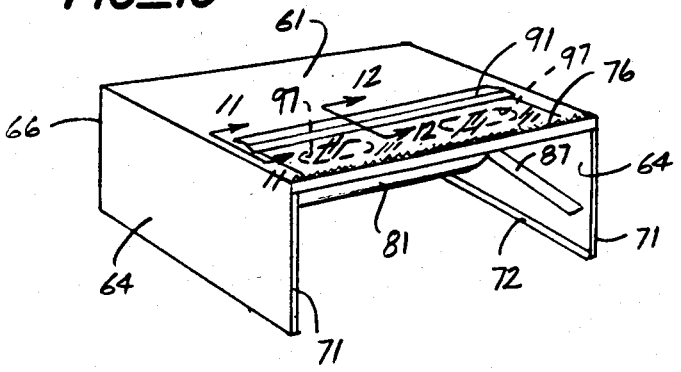
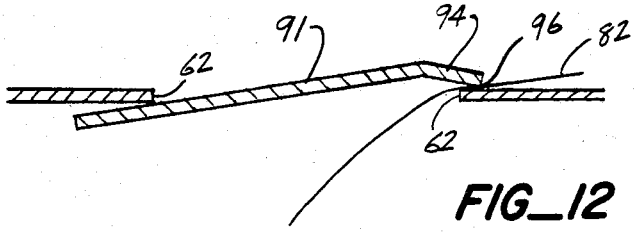
FIG_12
FIG_11
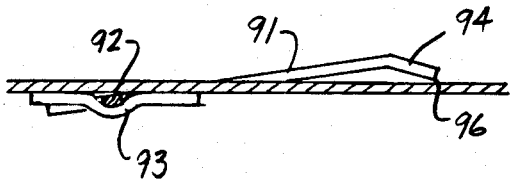
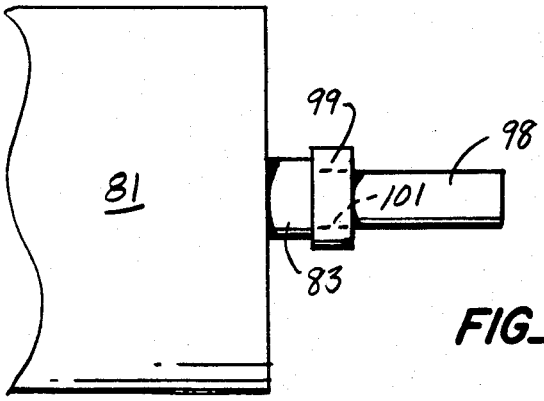
FIG_13

WRAPPING TABLE ASSEMBLY

This is a continuation-in-part of Ser. No. 597,520, filed Apr. 6, 1984, now abandoned, which was a continuation-in-part of Ser. No. 466,873, filed Feb. 16, 1983, now abandoned, which was a continuation-in-part of Ser. No. 416,669, filed Sept. 10, 1982, now abandoned.

This invention pertains generally to the wrapping of objects such as food products, and more particularly to a wrapping table assembly for use with a roll of wrapping material.

Wrapping materials such as plastic film are commonly supplied in rolls and disposable dispensing boxes for use in the wrapping of food products and other objects. One example of a box for dispensing plastic wrapping film is found in U.S. Pat. 3,739,964. Once removed from the box, the film material is awkward to use, and U.S. Pat. 3,771,700 discloses a wrapping table attachment which mounts on a dispensing box to provide a convenient work surface on which objects can be wrapped. Nevertheless, the dispensing boxes have certain limitations and disadvantages.

Dispensing boxes are relatively expensive to manufacture, and wrapping materials can be supplied more economically in bulk or in cartons containing a plurality of rolls of the material. Dispensing boxes are commonly made of cardboard, and they deteriorate rapidly when subjected to moisture in a food handling environment. In addition, individual dispensing boxes present a problem of disposal when they are empty.

It is a general object of the invention to provide a new and improved wrapping table assembly for use with rolls of wrapping material.

Another object of the invention is to provide a wrapping table assembly of the above character which is convenient and easy to use.

Another object of the invention is to provide a wrapping table assembly of the above character which can be used with rolls of different widths.

Another object of the invention is to provide a wrapping table assembly of the above character which is portable and can be readily set up for use.

These and other objects are achieved in accordance with the invention by providing a wrapping table assembly having a generally planar top with a slotted opening therein and a cutting blade extending along one edge of the top. A roll of wrapping material is rotatively mounted in a base beneath the top, and the free end of the material passes through the opening in the top. In some embodiments the roll of material is positioned toward the rear of the base where it is protected from contamination, and inclined guide members facilitate insertion of the roll from the front of the base. A trap door prevents the free end of the material from falling back through the opening in one embodiment, and in all embodiments the table can be used with rolls of different widths.

FIG. 1 is an isometric view of one embodiment of a wrapping table assembly according to the invention.

FIG. 2 is a front elevational view of the embodiment of FIG. 1.

FIG. 3 is a cross-sectional view taken along line 3—3 in FIG. 1.

FIG. 4 is a cross-sectional view taken along line 4—4 in FIG. 1.

FIG. 5 is a cross-sectional view similar to FIG. 3 of a second embodiment of a wrapping table assembly according to the invention.

FIG. 6 is a cross-sectional view similar to FIG. 4 of the embodiment of FIG. 5.

FIG. 7 is a perspective view of another embodiment of a wrapping table assembly according to the invention.

FIG. 8 is an enlarged sectional view taken along line 8—8 in FIG. 7.

FIG. 9 is an enlarged fragmentary view of the region indicated by line 9—9 in FIG. 8.

FIG. 10 is a perspective view of another embodiment of a wrapping table according to the invention.

FIGS. 11 and 12 are enlarged fragmentary sectional views taken along lines 11—11 and 12—12 in FIG. 10.

FIG. 13 is a fragmentary elevational view of a spindle and collar for holding rolls of wrapping material of different widths in the embodiment of FIG. 10.

In the drawings, the wrapping table assembly is illustrated in connection with a roll 11 of wrapping material such as plastic film. The roll comprises an elongated sheet 12 of the material wrapped about a cylindrical core 13 which is hollow in the embodiment illustrated. The core is somewhat longer than the width of the material, and the end portions 14 of the core project from the edges of the rolled material. The table assembly comprises a generally L-shaped table member 16 having a rectangular, generally planar top 17 and a depending flange 18 which extends along the rear edge of the top. An elongated generally rectangular slotted opening 19 is formed in the table top in spaced parallel relation to flange 18. In one presently preferred embodiment, table member 16 is fabricated as a unitary structure of sheet metal such as stainless steel, but it can be fabricated from any other suitable material, if desired. The front and side edge portions of table top 17 are turned down and the side and bottom edge portions of flange 18 are turned forward to form flanges 21–24 which add rigidity to the structure.

The table assembly also includes a pair of legs 26 which cooperate with flange 18 to support table top 17 in a predetermined position, e.g., horizontal, above a supporting surface (not shown). Each of the legs comprises a generally rectangular upright panel 27 having an upper edge 28 upon which the lower surface of the table top rests. The legs are positioned generally beneath slotted opening 19, with the upright panels generally parallel to the side edges of the table top. The legs are fabricated of the same material as table member 16, with inwardly extending flanges 31, 32 along the side and bottom edges of panels 27.

Legs 26 each have a mounting tab 33 which projects upwardly from panel 27 through slotted opening 19 and interfits with table top 17 to hold the legs and the table top together and permit adjustment of the legs lengthwise of the opening to accommodate rolls of different widths. The upper portion of each mounting tab is turned over in an outward direction to form a horizontally extending flange 34 having a length somewhat greater than the width of opening 19. The lower surface of flange 34 is spaced above the upper edge 28 of panel 27 by a distance slightly greater than the thickness of table top 17, and flange 34 is positioned adjacent to the upper surface of the table top when the lower surface of the top rests on edge 28. The width of flanges 34 is less than the width of opening 19, and the legs are installed by passing tabs 33 upwardly through the opening with flanges 34 extending lengthwise of the opening, then rotating the legs about a vertical axis until flanges 34 and upper edge 28 extend cross-wise of the opening with the table top between them.

In the embodiment illustrated, rear flange 18 and the panel portions of legs 26 are all of equal height, and mounting feet 36 are mounted on the lower flanges 24, 32 of these elements for engagement with the supporting surface on which the assembly rests.

Means is provided for mounting the roll of wrapping material for rotation about an axis spaced beneath and generally parallel to slotted opening 19. This means includes circular openings 39 formed centrally in the panel portions 27 of the legs to rotatively receive the end portions 14 of roll core 13. The end portions extend through the openings, and end caps 41 are mounted on the end portions of the outer sides of the legs to retain the roll of material in position between the legs. The end caps are fabricated of plastic or other suitable material, with an inner diameter corresponding to the outer diameter of the roll core, whereby the caps are held on the core by friction and can be removed readily therefrom.

FIG. 2 illustrates the manner in which legs 27 can be positioned longitudinally of slotted opening 19 to accommodate rolls of different widths. In this figure, the legs are shown in full lines in position for holding a longer roll and in phantom lines in position for holding a narrower roll. In this particular embodiment, the left leg is in the same position for both rolls, and the right leg is moved toward the center of the table for the narrower roll.

A plurality of access openings 43 are provided in table top 17. These openings are located between slotted opening 19 and the front edge of the table top in positions corresponding to the positions of legs 26 for rolls of different widths. Corresponding openings 44 are provided in the upper portions of leg panels 27, and when the legs are in position to hold a roll of wrapping material, openings 44 are aligned with the corresponding openings 43.

A cutting blade 46 is mounted on flange 21 and extends along the front edge of table top 17 in a direction generally parallel to slotted opening 19 for cutting a length of wrapping material from roll 11 as it is wrapped about an object.

Operation and use of the wrapping table assembly is as follows. Legs 26 are installed on table member 16 as described above by inserting mounting tabs 33 through slotted opening 19 from the underside of table top 17 and turning the legs to bring flanges 34 into alignment cross-wise of the opening. The roll of wrapping material is positioned between the legs, and one or both of the legs is adjusted lengthwise of the slotted opening so that the end portions 14 of the roll core extend through leg openings 39. End caps 41 are installed on end portions 14 to retain the roll and the legs in their relative axial positions. The free end 49 of the wrapping material is passed upwardly through opening 19 through the upper side of the table top where the objects are wrapped. The side edges of the wrapping material pass over openings 44 and are easily grasped even with a material such as plastic film which tends to cling to the table top.

The embodiment of FIGS. 5–6 is generally similar to the embodiment of FIGS. 1–4, and like reference numerals designate corresponding elements in the two embodiments. In the embodiment of FIGS. 5–6, the roll of wrapping material is rotatively mounted on hubs 51 which are carried by legs 26. The hubs comprise annular flanges which project inwardly from leg panels 27 and are rotatively received within the tubular core 14 of the wrapping material roll. The hubs are aligned on an axis below and generally parallel to slotted opening 19. The outside diameter of hubs 51 is slightly less than the inside diameter of core 14, and the hubs project a relatively short distance, e.g. one-half inch, into the core. In this embodiment, the roll is mounted on the hubs by separating the lower portions of legs 26, inserting the hubs into the ends of the core, and drawing the legs together again.

In the embodiment of FIGS. 5–6, the free end 49 of the wrapping material extends in an upward and forward direction from the lower side of the roll, around cutting blade 46 to the upper surface of table top 17. As the material is withdrawn from the roll, the roll rotates in the counterclockwise direction, as indicated by arrow 52 in FIG. 6. A wrapping material such as a plastic film tends to cling to the front face of the blade, producing an easier, cleaner cut than when the material is brought out through slot 19 and pulled downwardly across the blade to cut it.

Operation and use of the wrapping table assembly of FIGS. 5–6 is generally similar to the operation and use of the embodiment of FIGS. 1–4. In this embodiment, however, the wrapping material is brought out beneath the table top and pulled upwardly around cutting blade 46 and back across the upper side of the table top. The object to be wrapped can be placed either on or below the film on the upper surface of the table, then wrapped on the table top. The free end of the film is severed from the roll by pulling it back across the cutting edge of the blade. Once the cut has been made, the new free end of the film clings to the blade and remains in the position shown in FIG. 6. When another piece of film is desired, the reach between roll 11 and cutting blade 46 can be grasped at its edges and pulled up and around the cutting blade to the table top.

If desired, the wrapping material in the embodiment of FIGS. 1–4 can be brought out beneath the table top and around cutting blade 46 in the manner illustrated in FIG. 6. In order to do so, the only change required is to reverse the roll of material so that the free end extends in a forward direction from the lower side of the roll. Alternatively, the wrapping material can be brought out through slot 19 in the embodiment of FIGS. 5–6.

When the wrapping material is drawn up around the cutting blade in the manner illustrated in FIG. 6, the weight of the roll and the table is generally sufficient to hold the table down on the supporting surface. If additional stability is desired, suction cups can be utilized in place of the mounting feet 36 toward the front of the legs.

In the embodiment of FIGS. 7–9, the wrapping table assembly has a generally rectangular table top 61 with an elongated slotted opening 62 generally parallel to the front and rear edges of the top. The table top is supported by a base 63 having side panels 64, a rear panel 66 and an open front 67. In the embodiment illustrated, table top 61 and rear panel 66 are formed as a single L-shaped member, and side panels 64 are formed separately and affixed to this member. Top wall 61 and rear panel 66 have flanges 68, 69 which overlap the top and rear margins of panels 64, flanges 71, 72 extend along the front and lower edges of the side panels, and a flange 73 extends along the lower edge of rear panel 66.

Mounting feet 74 are provided at the four corners of the base.

A cutting blade 76 extends along the front edge of table top 61. As best seen in FIG. 9, a flange 77 of generally U-shaped cross-section extends along the front edge of the table top, and the cutting blade is clamped between the inner section 78 and the outer section 79 of this flange.

A roll of wrapping material 81 is rotatively mounted between side panels 64 beneath table top 61. The roll comprises an elongated sheet 82 of the wrapping material (e.g. plastic film) wrapped about a cylindrical core 83. The end portions of the cylindrical core project from the side edges of the rolled material and are rotatively received in semicircular journals 86 mounted on side panels 64. The upper sides of the journals are open, and the end portions of the core are inserted into and removed from the journals through these open sides. When the core is seated in the journals, the roll is held securely against the pull exerted on the roll as the material is drawn therefrom. Guides 87 extend between the journals and the open front of the base to facilitate installation of the roll of wrapping material. As best seen in FIG. 8, the guides are inclined upwardly and rearwardly from the front of the base to the open sides of the journals. The journals and the guides project horizontally inward from the side panels, with a width corresponding to the width of flanges 71. In the embodiment illustrated, each of the journals and its associated guide is fabricated as a unitary structure with mounting tabs 88, 89 for securing the structure to the side panel.

The table assembly of FIGS. 7–9 can be fabricated of any suitable material. In the embodiment illustrated, the table top, the side panels and the journal and guide members are fabricated of stainless steel, and they are joined together by spot welding.

Operation and use of the embodiment of FIGS. 7–9 is as follows. The roll of wrapping material is installed through the open front 67 of base 63, and the end portions of cylindrical core 83 are slid or rolled along guides 87 until they drop into journals 86. The free end of the wrapping material 82 is drawn in a forward direction from the lower side of the roll and passed in an upward direction through opening 62 in the table top. When the assembly is placed on a supporting surface, the base is essentially closed on all sides except the front, and being positioned toward the rear of this enclosure, the roll of wrapping material is substantially enclosed and protected from contamination.

The embodiment of FIGS. 10–12 is generally similar to the embodiment of FIGS. 7–9, and like reference numerals designate corresponding elements in the two embodiments. In the embodiment of FIGS. 10–12, however, table top 61, side panels 64 and rear panel 66 are fabricated as a unitary structure, e.g. by cutting the same from a sheet of stainless steel, bending the side and rear panels down along the side and rear edges of the table top, and securing the panels together at the rear corners of the base. In this embodiment, front flanges 71 are narrower than guides 87, and the front edges of the guides are set back a short distance from the front side of the base.

In the embodiment of FIGS. 10–12, slotted opening 62 is provided with a hinged flap or trap door 91. This flap comprises a generally rectangular member having a length slightly less than the length of the opening and a width slightly greater than the width of the opening. The flap is pivotally mounted in the opening by means of pins 92 which project longitudinally from the ends of the flap and are pivotally received in sockets 93 on the underside of the table top. The pins are positioned toward the rear of the flap, and the weight of the flap tends to hold it in a closed position with the front edge of the flap bearing down against the upper surface of the table top and the rear edge of the flap engaging the lower side of the table top. The flap serves as a closure for opening 62 and prevents contaminants such as particles from the object being wrapped from falling through the opening and contaminating the wrapping material. The wrapping material passes between the front edge of the flap and the table top, and the flap prevents the free end of the wrapping material from falling back through the opening. The front portion 94 of the flap is turned down slightly, as best seen in FIGS. 11 and 12, and the wrapping material is gripped between the lower front corner 96 of the flap and the table top. Since the front portion of the flap is free to pivot in an upward direction, the flap does not interfere with the passage of wrapping material through the opening as it is withdrawn from the roll.

Openings 97 are formed in the table top in front of slotted opening 62 to facilitate grasping the free end of wrapping materials such as plastic films which tend to cling to the table top. These openings provide areas in which the user can depress the material in order to grasp the same.

As illustrated in FIG. 13, the roll of wrapping material 81 is mounted on a spindle 98 which passes through core 83 and is rotatively received in journals 86. Rolls of different widths can be mounted on the spindle, and with rolls substantially narrower than the spacing between the journals, collars 99 are mounted on the spindle at the ends of the rolls to prevent undesired longitudinal movement of the rolls on the spindle. The collars have an axial bore 101 of approximately the same diameter as the spindle, and they are held in place on the spindle by friction.

Operation and use of the embodiment of FIGS. 10–12 is generally similar to the operation and use of the embodiment of FIGS. 7–9. In this embodiment, however, the free end of the wrapping material passes between the front edge of the trap door or flap 91 and the upper side of the table top, and the flap prevents the free end from falling back through the opening. The flap also closes the opening and prevents contaminants from falling onto the wrapping material below.

The invention has a number of important features and advantages. It provides a wrapping table for use with unboxed rolls of wrapping material. The assembly is self-supporting and can be adjusted to accommodate rolls of different widths. The assembly is portable and can be readily set up for use.

It is apparent from the foregoing that a new and improved wrapping table assembly has been provided. While only one presently preferred embodiment has been described in detail, as will be apparent to those familiar with the art, certain changes and modifications can be made without departing from the scope of the invention as defined by the following claims.

I claim:

1. A wrapping table assembly for use with a roll of wrapping material, comprising a table member having a generally planar top with a slotted opening formed therein and a depending flange extending along one edge of the top, a pair of legs depending from the table top and cooperating with the depending flange to support the table top in a predetermined position above a supporting surface, means carried by the legs for rotatively supporting the roll of material beneath the table top with the free end of the material extending to the upper side of the table top, and mounting tabs which project from the legs through the slotted opening and interfit with the table top in a manner holding the legs and the table top together and permitting the legs to be moved longitudinally of the slotted opening to accommodate rolls of different widths.

2. The wrapping table assembly of claim 1 wherein each of the legs comprises a generally planar upright member having an upper edge on which the table top rests, and the mounting tabs have horizontally extending flanges which extend beyond the edges of the slotted openings on the upper side of the table top.

3. The wrapping table assembly of claim 1 wherein the wrapping material is wrapped about a cylindrical body, and the legs are formed with aligned openings through which the end portions of the cylindrical body extend.

4. The wrapping table assembly of claim 3 including retaining caps mounted on the end portions of the cylindrical body on the outer sides of the legs.

5. The wrapping table assembly of claim 1 wherein the wrapping material is wrapped about a cylindrical core and the legs have axially aligned hubs which rotatively engage the cylindrical core of the wrapping material.

6. The wrapping table assembly of claim 1 further including a cutting blade positioned along an edge of the table top generally parallel to the slotted opening.

7. The wrapping table assembly of claim 6 wherein the free end of the wrapping material extends beneath the table top and upwardly about the cutting blade to the upper side of the table top.

8. The wrapping table assembly of claim 1 wherein the free end of the wrapping material extends through the slotted opening to the upper side of the table top.

9. A wrapping table assembly for use with a roll of wrapping material having a cylindrical core, comprising an L-shaped table member having a generally rectangular planar top with an elongated slotted opening therein and a depending flange extending along one edge of the top in a direction generally parallel to the opening, a pair of legs each comprising a generally planar panel slidably mounted in the slotted openings, and extending downwardly from the table top for cooperation with the depending flange to support the table top in a predetermined position, said legs being oriented with their generally planar panels perpendicular to the depending flange, axially aligned openings in the generally planar panels of the legs for receiving the end portions of the cylindrical core to rotatively support the roll of wrapping material between the legs with the free end of the wrapping material extending upwardly through the slotted opening of the table top, and end caps mounted on the end portions of the cylindrical core on the outer sides of the legs to retain the roll of wrapping material in a predetermined axial position relative to the legs.

10. The wrapping table assembly of claim 9 wherein the legs have mounting tabs which project through the slotted opening and interfit with the table top in a manner holding the legs and the table top together and permitting the legs to be moved longitudinally of the slotted opening to accommodate rolls of different widths.

11. The wrapping table assembly of claim 9 wherein each of the legs has a mounting tab which extends upwardly through the opening in the table top, with a flange at the upper end of the tab extending crosswise of the slotted opening and projecting beyond the lateral edges of the opening on the upper side of the table top.

12. The wrapping table assembly of claim 9 including a cutting blade extending along an edge of the table top generally parallel to the slotted opening.

13. In a wrapping table assembly for use with a roll of wrapping material having a cylindrical core: a generally rectangular table top, a supporting base having side and rear panels forming an enclosure at the sides and rear of the top with the front of the base being open, journal members projecting inwardly a limited distance from the side panels for receiving the end portions of the roll and supporting the roll for rotation about an axis positioned toward the rear of the base, and guide members extending along the side panels from the journal members toward the front of the base for guiding the end portions of the roll into the journal members when the roll of wrapping material is inserted into the base through the open front and rolled rearwardly along the guide members.

14. The wrapping table assembly of claim 13 wherein the journal members are open on their upper sides, and the guide members are inclined rearwardly and upwardly from the front of the base to the upper sides of the journal members.

15. The wrapping table assembly of claim 13 including a cutting blade extending along the front edge of the table top.

16. The wrapping table assembly of claim 13 wherein a flange of generally U-shaped cross-section extends along the front edge of the table top, and the cutting blade is secured between two sections of the flange.

17. The wrapping table assembly of claim 13 including an elongated slotted opening in the table top through which the free end of the wrapping material passes, and a flap member pivotally mounted in the opening for gripping the wrapping material and preventing the free end from falling back through the opening.

18. The wrapping table assembly of claim 13 wherein the roll of wrapping material is mounted on a spindle which extends through the core and is received in the journal members.

19. The wrapping table assembly of claim 18 including a collar mounted on the spindle at one end of the core to prevent longitudinal movement of the roll on the spindle.

20. In apparatus for wrapping an object with a plastic film material: a generally rectangular table top having an elongated slotted opening generally parallel to the front and rear edges thereof, a base having support members at the side and rear edges of the table top for supporting said top in a predetermined position above a supporting surface, said support members cooperating with the table top and the supporting surface to form an enclosed space toward the rear of the base with the front side of the base being open, journal members carried by the support members toward the rear of the base, a roll of plastic film material rotatively mounted between the journal members with the free end of the film material passing through the slotted opening in the table top, a pivotally mounted flap member closing the opening and engaging the film material to prevent the free end of the material from falling back through the opening, a cutting blade extending along the front edge of the table top for cutting the film material, and guide members extending along the side support members from the journal members toward the front of the base for guiding the roll of film material to the journal members when the roll is inserted from the front of the base.

21. The apparatus of claim 20 wherein the journal members are open on their upper sides, and the guide members are inclined rearwardly and upwardly from the front of the base to the upper sides of the journal members.

* * * * *